United States Patent [19]

Cloutier

[11] 4,161,155

[45] Jul. 17, 1979

[54] PATCH FOR SHIP HULLS

[76] Inventor: Charles C. Cloutier, P.O. Box 885, Morgan City, La. 70380

[21] Appl. No.: 921,025

[22] Filed: Jun. 30, 1978

[51] Int. Cl.[2] ..... B63B 43/16

[52] U.S. Cl. ..... 114/227; 114/229

[58] Field of Search ..... 114/227, 229, 221, 222, 114/68

[56] References Cited

U.S. PATENT DOCUMENTS

| | | | |
|---|---|---|---|
| 1,306,938 | 6/1919 | Achiha | 114/229 |
| 1,573,909 | 2/1926 | Blumberg | 114/229 |

*Primary Examiner*—Trygve M. Blix
*Assistant Examiner*—James B. Bechtel
*Attorney, Agent, or Firm*—Jones, Tullar & Cooper

[57] ABSTRACT

An inflatable fluid-filled bladder for covering damaged areas of ship and barge hulls is disclosed. The bladder is lined on one side with a foam material which engages and seals the damaged area of the hull, and is covered on the opposite side with a wire net which positions and holds the bladder against the hull by means of suitable cables and winches. An edge frame to which the wire net is secured is provided around the bladder and an upstanding bracket is secured to the frame. Tension cables connected to the apex of the upstanding bracket exert pressure through the bracket legs to the edge frame to improve the seal between the edge of the patch and the surface of the hull.

12 Claims, 8 Drawing Figures

FIG.4
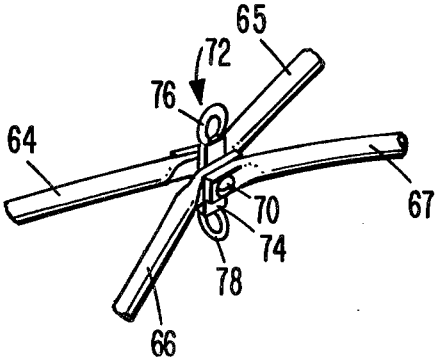
FIG.5
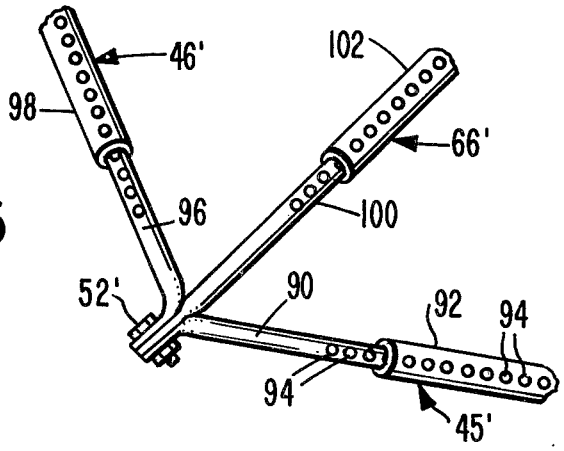
FIG.6
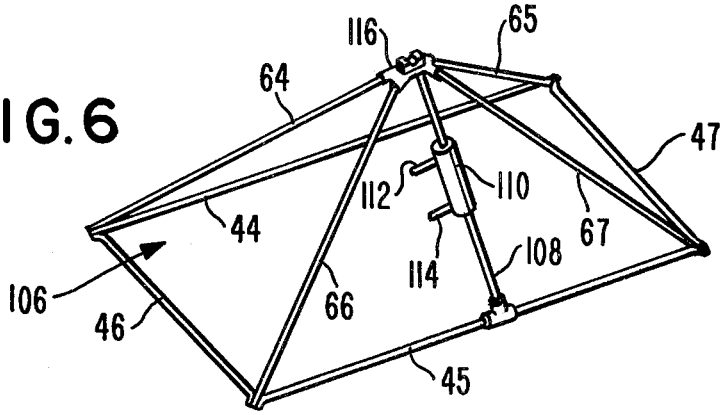
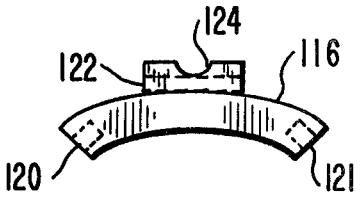
FIG.7
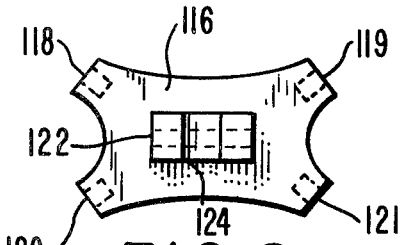
FIG.8

PATCH FOR SHIP HULLS

BACKGROUND OF THE INVENTION

The present invention relates, in general, to patches for the hulls of ships, barges, and other vessels, and more particularly to an improved patch structure which consists of a plastic or rubber inflatable bladder covered on the interior side with a foam sealer layer and on the exterior surface with a woven wire net which reinforces the bladder and by which it is secured to the hull of the ship.

There is a serious and growing problem occurring in the navigable waters of this and other countries created by the increased consumption of chemical and petroleum products and the increasing use of tanker ships and barges for transporting such products. Such vessels are susceptible to damage not only from storms, but from collisions, grounding, and other accidents, with the result that oil and chemical spills are becoming commonplace at sea and in harbors and rivers. The public is becoming increasingly aware of, and sensitive to, the damage resulting from such spills, and there is a strong and growing demand that controls be provided to protect the environment and to reduce the high costs of cleaning up oil and other spilled materials and repairing the damage done.

One of the difficulties faced in trying to prevent the extensive damage caused by oil and other spills is the fact that once a hull is breached and it begins to leak, there has been no effective way to stop it, particularly when the cause of the breach is the grounding of a vessel. Although the prior art suggests numerous ways to seal a leaking hull, virtually all of such prior art patches were designed to prevent water from flowing into the hull; almost none were designed to prevent fluid from leaking out. Further, the rules applicable to many harbors and inland waters generally require that once a vessel begins to leak, it cannot be moved, but must be unloaded. Since such leaks often occur when a ship or barge has gone aground, it often occurs that the hull is virtually inaccessible, and unloading becomes a difficult, time consuming and costly exercise. Even if the vessel is accessible, unloading it does not stop the leak until the barge is virtually empty, and thus unloading does not prevent damage, but merely reduces its scope. Although this is a help, it does not solve the problem.

Because of the damage potential of a barge or ship full of oil, and because the cost of unloading such a hull if a leak occurs can be extremely high, and further because of the amount of insurance that must be carried to protect against such an event and against subsequent charges for damages caused by the leaking oil, the cost of transporting oil by ship or by barge has substantially increased in recent times. Accordingly, there is a strong demand for an effective, easy to use, and economical method and apparatus for patching leaking hulls, not only among environmentalists who are concerned with the irreversible damage done by leaking oil, but by shippers and owners in the industry who face severe economic pressures.

The prior art discloses numerous structures in the form of mats or the like which are designed to prevent leakage of water into a hull. Exemplary of this art are the following U.S. Patents :Nos. 136,817 to Cooper; 331,658 to Sooysmith; 353,718 to Tuck; 635,939 to Mason; 1,107,680 to Lucka; 1,306,938 to Achiha; 1,573,909 to Blumberg; 2,127,871 to Kozloff; and 2,446,190 to Oding. Each of the foregoing patents discloses some type of apparatus for closing holes which appear in hulls, and the bulk of them show the use of cables or lines passing around the hull for use in positioning the mat. U.S. Pat. No. 3,669,055 to Buce discloses a mat for sealing an opening in an oil tanker for preventing an inflow of water and an outflow of oil. This patent also uses cables or lines passing at least part way around the hull for locating the patch in the desired area.

Although each of the foregoing patents discloses a patch arrangement, it has been found that these structures in fact are ineffective, and do not solve the problem which exists in attempting to retain a full load of oil in a hull such as that of a supertanker or a river barge. Although the patent to Buce suggests that such patches may be used for retention of oil, the approach taken by that patent is essentially the same as that taken by the earlier patents; namely, the provision of a series of cables or lines extending around the hull and pressing against the outside of the patch to hold it in position. Because of the moment arms involved, a cable stretched in such a manner cannot be drawn tightly enough to secure a patch in sealing relationship to the outside surface of a hull. Further, most of the patches disclosed in thes patents are designed for use with relatively flat surfaces, and cannot be used in conjunction with irregular surfaces such as the curved portions of the hull on a ship, the relatively square corners on a barge, or the irregularity of the keel area. In addition, the prior art patches are unwieldy and difficult to handle and require special equipment which is not normally found on shipboard or with barges. Thus, they require a large investment in equipment, and do not help to reduce the overall costs of shipping such materials.

BRIEF SUMMARY OF THE INVENTION

The present invention overcomes the difficulties inherent in prior art devices and provides an effective yet relatively inexpensive apparatus for closing and sealing damaged hulls quickly and with a minimum of time and equipment. The invention utilizes readily available materials that are generally available on all ships and barges to provide a device which is simple, easy to install, and effective to completely seal holes which occur anywhere on a hull. the seal of the present invention is conformable to the shape of the hull at the location of the damage, and may be secured in place sufficiently tightly to effectively prevent leakage and, in addition, to permit movement of the barge or ship after the hole has been sealed.

In brief, the hull sealing apparatus of the present invention comprises an inflatable bladder which carries on its inner surface a foam sealer layer adapted to conform to the irregularities on the surface of a hull to be sealed. This foam layer accommodates small irregularities such as barnacles and also serves to protect the bladder from damage. The exterior surface of the bladder is covered by a wire net, the net preferably being woven in such a way that the wires form loops around the periphery of the bladder which are adapted to receive a suitable frame, preferably formed from steel rods or tubes. The wire net is secured to the bladder for easy placement, and preferably is slightly smaller than the bladder so that the steel frame is adjacent but slightly inside the peripheral edge of the bladder. Locating cables connected to a number of spaced locations along the peripheral frame extend both longitudinally and transversely about the hull and and enable the patch to be moved along the hull for positioning over a breach. Upon tightening and securing of the cables, the wire net is pulled tightly over the bladder to hold the patch against the hull. The positioning and securing of the patch may be accomplished by suitable hand operated winches located on the ship or barge, in known manner.

To insure a leak-proof seal around the entire periphery of the damaged area of the hull, an upstanding sealing and reinforcing frame, which for convenience will be referred to herein as a bracket, is provided on the exterior side of the bladder. The bracket is secured to the peripheral frame to which the wire net is secured, and cooperates with that frame to provide the required edge seal for the bladder. The bracket is pressed against the bladder frame by means of one or more tensioning cables which pass over and are secured on the apex of the bracket. The ends of the tension cable are connected to a suitable device such as a winch by which the cable may be tightened.

The upstanding bracket arrangement permits a much more efficient transfer of force from the tension device to the peripheral edge of the bladder than is possible with the bladder locating cables, and thereby provides a highly effective seal around the edge of the bladder. The effective force produced by the tension cable and the bracket arrangement is sufficient to effectively seal an opening at any point on a hull, and provides sufficient force to permit the hull to be moved after installation of the patch, without the fear of further leakage.

The steel frame members at the periphery of the patch may be curved or bent to match the curvature of the vessel at the location of the leakage so that a proper seal is obtained. Further, the bracket incorporates a plurality of spaced legs which allow pressure to be applied to the bladder edges even around a sharp corner or adjacent a keel without any significant loss in sealing pressure, thus insuring that a hole which occurs at any location on the hull of a vessel can be sealed sufficiently tightly to prevent the leakage of oil or other fluids carried in the hull, as well as to prevent the flow of sea water into the hull.

Accordingly, there has been provided a new and improved sealing apparatus for openings which occur in hulls, and which permits prompt, inexpensive, and effective patching of such openings so as to minimize damage and substantially decrease the cost of such leaks. Because the patch of the present invention only requires an inflatable bladder, preferably of rubber, plastic, or like material, wire netting, pipes, cables and winches, all of which materials normally are readily available on ships or barges, the device can be constructed easily and inexpensively, and can be made available for use on virtually all vessels which carry liquid cargos. Further, since the device is easy to use and simple to handle, it is anticipated that it will find ready acceptance, thereby increasing the chances that it will be used, and thereby significantly reducing the costly effects of oil leaks in a way that has not previously been possible.

BRIEF DESCRIPTION OF THE DRAWINGS

The foregoing and additional objects, features and advantages of the present invention will become apparent from a consideration of the following detailed description of a preferred embodiment thereof, given in terms of the best mode presently contemplated and taken in conjunction with the accompanying drawings, in which:

FIG. 4 is an enlarged view of the top junction of the bracket portion of the patch of FIG. 1;

FIG. 5 is an enlarged view of the corner joint of the patch frame, showing a modified form thereof;

FIG. 6 is a perspective view of another embodiment of the patch frame of the present invention;

FIG. 7 is a side view of a spider connector for securing the legs of the bracket of FIG. 6; and FIG. 8 is a top plan view of the spider of FIG. 7.

DESCRIPTION OF PREFERRED EMBODIMENTS

Figure 1:
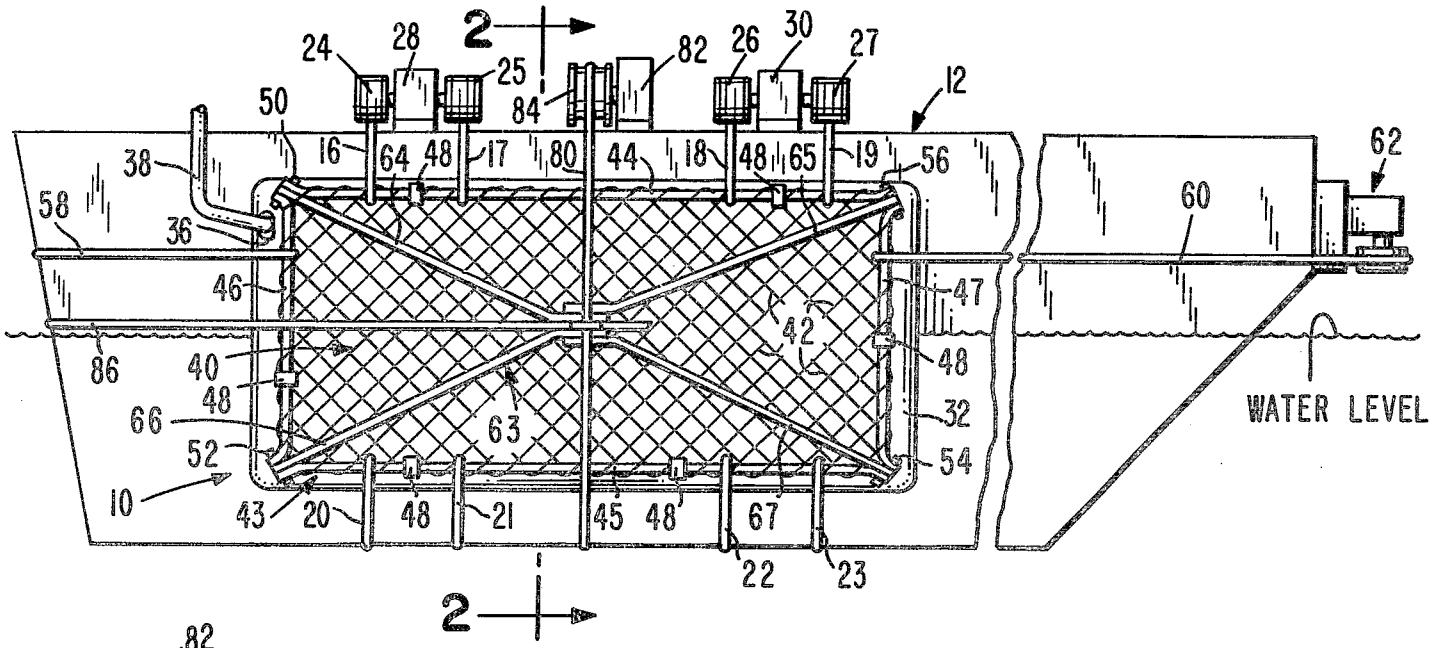
FIG. 1 is a plan view of a patch constructed in accordance with the present invention and positioned over a damaged area on a barge.
Figure 2:
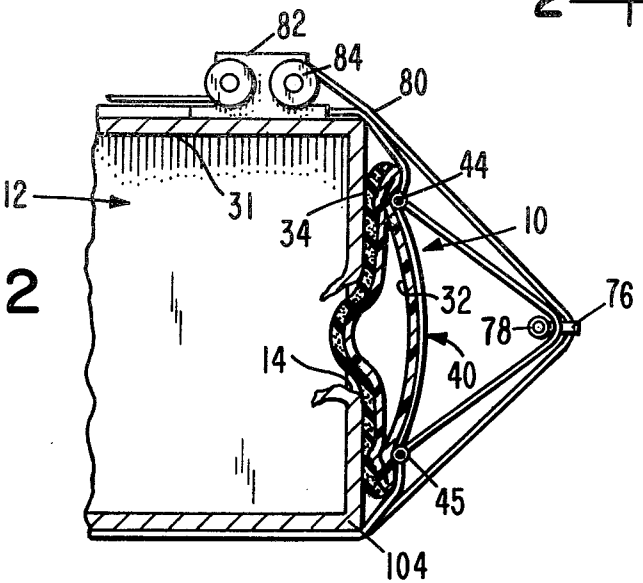
FIG. 2 is a sectional view of the patch, taken along lines 2—2 of FIG. 1.

Referring now to FIGS. 1 and 2, there is illustrated at 10 an inflatable patch for covering and sealing damaged areas of ship and barge hulls. The patch is shown as being positioned on the hull of a vessel 12 where it is positioned over a damaged area such as a hole 14 (FIG. 2) by means of transverse support cables 16–19 and 20–23. The upper cables 16–19 are secured to cable drums 24–27, respectively, of hand-operated winches 28 and 30 mounted on the deck 31 of vessel 12. Lower cables 20–23 are similarly connected to corresponding cable drums on winches (not shown) also mounted on the deck either adjacent winches 28 and 30 or on the opposite side of the vessel. All of the winches preferably are movably mounted on the vessel 12 to allow the patch to be positioned where needed along the length of the vessel. Although it is preferred that the winches all be hand-operated to allow proper positioning of the patch without damage to the patch and to protect the operators, electrically operated winches may be used with appropriate controls, if desired. It will be noted that the lower cables 20–23 pass under the hull of the vessel so that the winches to which they are connected may be secured on the deck for easy access and control.

The patch 10 consists of a single inflatable bladder 32 constructed of a suitable material such as plastic, neoprene rubber, or like material which is capable of withstanding not only the mechanical stresses placed on it but also the chemical effects of oil, gasoline, and other like hydrocarbons, or the effect of other chemicals which might be carried in the vessel hull. The bladder is constructed with a relatively thick wall which is sufficiently strong to withstand the forces involved in placing the patch on the hull and securing it there to in such a way as to seal the damaged area and permit the vessel to be moved to an area where it can be unloaded.

The inner surface of the bladder is covered by a layer of foam material 34 which may be foam rubber or foamed plastic and which provides a flexible surface which will easily conform to small irregularities on the hull, such as are produced by barnacles or the like. The foam surrounds such irregularities and thus serves to ensure a good tight seal around the edges of the damaged area 14. The bladder wall and the foam layer are sufficiently flexible to conform to the edge of the damaged area so that when pressure is applied to the securing frame (to be described), the bladder will be held tightly in position and provide an effective seal against leakage of material out of the vessel 12.

As illustrated in FIG. 1, the pillow 32 is a single closed bladder having an opening 36 near the upper edge thereof to which a filler tube 38 may be secured by suitable means. Thus, the filler tube may be molded to the bladder, or may be secured thereto by suitable conventionally available threaded fittings, or the like, the particular connection of the filler tube to the bladder not comprising a part of this invention. The filler tube 38 communicates at one end with the interior of the bladder and is connected at its opposite end to suitable pump means (not shown), by which the bladder may be filled with a suitable fluid. This fluid may be sea water, when the patch is not required to act as a flotation device, may be air when flotation is required, or may be a combination of the two, depending upon the location of the damaged area and the condition of the hull.

Figure 3:
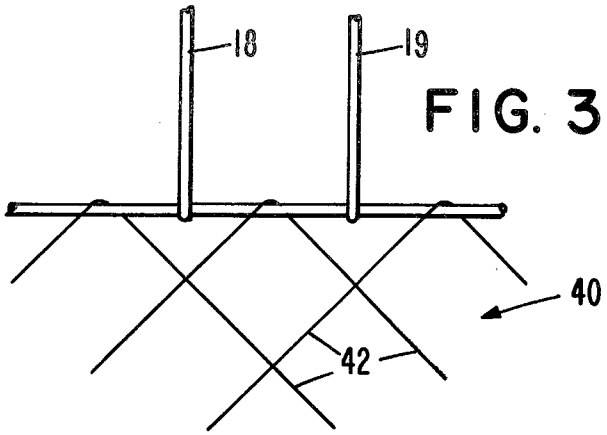
FIG. 3 is an enlarged view of the edge support for the patch.

The bladder 32 is covered, reinforced, and held in place by a wire net 40 consisting of strands 42 interwoven and crisscrossing the outer surface of the bladder. This wire net, or mesh, is secured to a peripheral frame 43 consisting of interconnected side and end tubes 44, 45, and 46, 47 which hold the net taut so that it will firmly engage the outer surface of bladder 32. Preferably, the wire net is secured to the frame members by forming the net in such a way that the strands form a series of loops around the peripheral edges of the mesh. These loops receive the side and end frame members in the manner diagrammatically illustrated in FIG. 3 so that the net is held uniformly tight, and any stresses on the frame members will be distributed over the net. Further, such a construction allows easy assembly and disassembly of the patch so that the various parts can be easily stored or can be replaced if broken or damaged. The bladder preferably is secured to the frame 43 or to the net 40, or both, as by loops 48 formed on the bladder, through which the frame members 44–47 pass when the patch is assembled, or by embedding the wire net in the surface of the bladder.

The frame members 44–47 preferably are tubular steel and are interconnected to form a generally rectangular framework slightly smaller than the dimensions of the bladder 32, in the manner illustrated in FIG. 1. This framework may be assembled in any suitable manner, but a particularly advantageous construction is that which is illustrated in FIG. 1. In this arrangement, the ends of the tubes 44–47 are angled outwardly, flattened and drilled to receive suitable bolts so that adjacent side and end tubes may simply be bolted together in the manner illustrated. Thus, the side and end pieces 44 and 46 are flattened at their adjacent ends, drilled and secured by a suitable bolt 50. In similar manner, the end and side pieces 46 and 45 are flattened at their adjacent ends and are secured by a bolt 52, side end and frame members 45 and 47 are secured by a bolt 54, and end and side frame members 47 and 44 are secured by a bolt 56. Suitable brackets may be devised to received the ends of the various side and end poles, if desired, but such brackets must be specially designed and made for the particular size of pipe that is used, and would merely add to the complexity and the expense of the patch.

As illustrated in FIGS. 1 and 2, the frame elements 44–47 spread the mesh 40 over the outer surface of the bladder to hold it in place. The transverse cables 16–23 are secured to the side frame members 44 and 45, preferably at spaced locations along the framing tubes to tighten the mesh and to position and hold the bladder against the side of the hull. The frame members 44 and 45 serve to distribute the forces applied by the winches through cables 16–23 across the length of the patch so as to distribute the pressure evenly across its length and to improve the seal provided thereby. Although not fully illustrated in FIGS. 1 and 2, it will be understood that cables similar to those illustrated at 16–23 may be provided on the end frame members 46 and 47, with the cables extending longitudinally around the vessel and secured to suitably located winches (not shown) to further tension the mesh 40 and to also assist in moving the patch fore and aft along the vessel for proper location. Tightening of such cables also assists in holding the patch tightly against the hull. An example of such an arrangement is diagrammatically illustrated by the cables 58 and 60 connected to a winch 62 illustrated as being mounted to the bow end of the vessel 12.

In order to provide a secure seal against the leakage of material from within the vessel 12, even under relatively high internal pressures, or under very adverse weather conditions, the present invention contemplates the provision of a reinforcing framework 63, or bracket, extending outwardly from the peripheral frame 43 described above but engaging the peripheral frame at its corners. Framework 63 is illustrated in FIGS. 1 and 2 as including upstanding leg members 64–67 which preferably are of tubular steel. In the preferred mode, the framework 63 is secured at the four corners of the rectangular peripheral frame 43 by flattening and drilling the outer ends of tubes 64–67 so that they will receive the bolts 50, 52, 54, and 56. Thus, the outer end of leg 64 is flattened and drilled to receive bolt 50, the outer end of leg 55 is flattened and drilled to receive bolt 56, and so on. In this manner, the bracket framework is securely fastened to frame 43. The remaining, or upper, ends of the leg members 64 to 67 are also flattened and drilled in the manner illustrated in FIG. 4 so that they may be secured at the apex of the bracket in a suitable fashion, as by means of a bolt 70.

Secured at the apex of the bracket 63 is a cable fitting 72 which comprises a central plate 74 and two end rings 76 and 78. The center plate is adapted to be secured at the apex of the bracket by means of bolt 70, which clamps the fitting between the flattened upper ends of the legs 64–67, with the upper ring 76 extending above the apex and the lower ring 78 extending therebelow. The rings are secured to the central mounting plate at right angles to each other and are adapted to receive suitable tension cables for applying additional force through the bracket legs to the bladder to provide an improved seal. One such tension cable, illustrated at 80 in FIGS. 1 and 2, extends, for example, through the upper ring 76 and transversely around the vessel, the cable being secured at one end to a suitable winch 82, as by cable drum 84. A second tensioning cable may extend longitudinally around the hull in a similar manner, passing through ring 78 and being secured to a suitable tensioning device (not shown) in the manner of cable 80. Such a longitudinal cable is partially illustrated at 86 in FIG. 1.

As may be seen most clearly in FIG. 2, the bracket arrangement extends a considerable distance above the outer surface of the bladder 32 so that the tensioning cable 80 can be tightened by its associated winch 82 to produce a considerable degree of force on the tripod legs. The force produced upon tightening of the cables 80 is transferred through the bracket legs to the corners of the peripheral frame 43 and thence to the net 40.

Since the peripheral edges of the net and frame 43 are located inwardly of the edges of the bladder 32, the force exerted by tensioning cables 80 is applied to the bladder surface by means of the framework, thereby pressing the bladder securely against the hull and providing a strong and secure seal against leakage from within the hull. If a single cable 80 is not sufficient to provide a secure seal, a second cable 86 may be added.

As best illustrated in FIG. 2, the tripod frame 63 and cables 80 and 86 produce a much greater sealing force against the edges of the bladder than would be possible with the securing cables 16–23 because of the better leverage which the bracket provides. The securing cables 16–23 follow the contour of the hull of the vessel, and as a result the tension applied to such cables by their corresponding winches is effectively parallel to the surface of the vessel. Such a force is not capable of exerting a significant pressure against the side of the vessel, and thus cannot effectively hold the patch in place to prevent the outward leakage of fluid, even though such an arrangement may work satisfactorily to prevent water from entering a damaged area of the hull. The force applied by tension cables 80 and 86, on the other hand, is substantially perpendicular to the hull surface by reason of the bracket framework 63 and the peripheral frame 43. Thus, by virtue of the described structure, the patch of the present invention effectively seals any breaches in the vessel against outward leakage, as well as against leakage into the vessel.

Another embodiment of the invention is illustrated in FIG. 5 wherein the frame members 45', 46', and 66' are shown in modified form. In this version, some or all of the frame members may be telescopic, although only three members are illustrated. Frame member 45' may include, for example, an inner tubular section 90 and an outer tubular section 92 which are telescopically adjustable, with each of the sections 90 and 92 including a plurality of spaced holes 94 adapted to receive a pin or the like to secure the telescoping sections in the desired relationship. In a similar manner, frame members 46' and 66' are constructed of inner and outer tubular members, 96, 98 and 100, 102, respectively, to permit adjustment of their length.

The side and end telescopic frame members of the peripheral frame 43 may be adjusted to vary the dimensions of the wire net, as well as to adjust its tension when in place over the bladder, while the bracket frame members may be adjusted to accommodate the patch to curvatures in the hull. Thus, for example, if the patch is to be placed on a damaged area which occurs on a curved bottom portion of the hull or at the lower edge 104 (FIG. 2), it will be necessary for the patch to follow this curvature to provide an effective seal. One of the advantages of the present invention is that the frame members may be bent into a suitable shape to follow such a curvature so that the patch conforms to the hull shape, but it has been found that when this is done, in some circumstances the curvature reduces the effective distance between the apex of the bracket and the patch, and thereby reduces the effective leverage imparted to the patch by the bracket. By adjusting the bracket legs to lengthen them or shorten them as needed, the appropriate leverage can be maintained at the corners of the frame and the pressure exerted thereby can be balanced to provide an even pressure around the periphery of the patch.

Although the reinforcing framework 63 has been illustrated in FIG. 1 as having four legs extending to the corners of the peripheral frame 43, it should be understood that additional legs may be provided as required to ensure an even distribution of the pressure exerted by the tension cables 80 and 86. Thus, as illustrated in FIG. 6, the patch frame 106 may include the peripheral frame members 44–47 as before, together with the reinforcing frame 63 and its legs 64–67, again as before, with the addition of an auxiliary pressure leg 108 extending between the apex of the bracket frame and one of the frame members such as member 45. Although only one such auxiliary leg is illustrated, it will be understood that additional support legs may be provided as needed.

If desired, the auxiliary leg 108 may incorporate a suitable hydraulic drive cylinder 110 having inlet and outlet pressure hoses 112 and 114 by which the leg 108 may be extended or retracted to adjust the shape of frame member 45. Such adjustment may be required where the patch is placed over a damaged area in the hull, and it is found that the hull area is depressed in one section so that the patch will not seal. In such a case, cylinder 110 may be activated by suitable hydraulic pumps (not shown) to extend the auxiliary leg 108 and to bend the frame member 45 down into the depression, thereby conforming the patch to the shape of the hull. It will be apparent that similar hydraulic cylinders may be provided in each of the leg members of the bracket, if desired.

Although in the present illustration of the invention the junctures of the various frame elements are illustrated as being secured together by means of suitable bolts passing through flattened areas of the frame, it will be apparent that other fastening means may be used. Thus, for example, FIG. 6 illustrates a spider bracket 116 at the apex of the patch frame 106, the spider bracket being adapted to receive the four frame legs 64–67 in corresponding sockets 118–121. In the illustrated version, the spider bracket 116 is also provided with an aperture 122 which is adapted to receive a tensioning cable passing in one direction over the frame and a groove 124, transverse to aperture 122, for receiving the tension cable passing across the frame in a transverse direction. Similar brackets appropriately shaped may be provided to receive the various peripheral frame members and the lower ends of the bracket frame legs.

In using the hull patch of the present invention, the wire net 40 is first attached to the peripheral frame members 44–47, with the wires being stretched tightly across the frame opening. The bladder 32 is secured to the frame and the net, with the peripheral edge of the bladder extending beyond the frame members. The bracket legs 64–67 are secured to the peripheral members, the entire patch unit is attached to the support and placement cables 16–23, and the tensioning cables 80 and 86 are connected to the apex of the bracket legs. Thereafter, the patch is lowered over the side of the vessel and is positioned over the damaged area by means of the support cables and their associated winches, the patch preferably being centered over the damaged area. If the damaged area has occurred on a curved surface of the hull, the peripheral frame members 44–47 may be bent or otherwise deformed to conform the bladder to the hull shape, and if the bracket frame is provided with telescoping legs, the bracket may be adjusted to compensate for such shaping.

After the patch is in place, the patch is pulled against the hull by tightening the transverse cables 16–23 and any longitudinally extending cables that may be provided on the end frame members 46 and 47. The tensioning cables 80 and 86 are then tightened to cause the bracket legs to press the peripheral frame against the bladder, and to press the bladder against the hull. Thereafter, air or water, or both, under pressure is supplied to bladder 32 to fill it and to compress the patch against the damaged area. As indicated, the filling of the bladder presses the foam layer 34 against the hull of the vessel, and this, in combination with the pressure applied to the peripheral frame members, provides a secure seal around the edge of the damaged area.

It has been found that the patch structure of the present invention produces a seal which is sufficiently tight to completely prevent leakage of oil, chemicals, or the like from within a barge or other vessel. In a test of a prototype of the invention, the patch was found to be easily capable of withstanding a pressure of 15 lbs. per sq. inch, which is the equivalent of a 30 ft. head of pressure. Further, the patch is held sufficiently tightly against the hull to permit the vessel to be moved to a dock for unloading with the patch in place, thus overcoming one of the major difficulties of prior art patches.

The arrangement described herein provides a simple, inexpensive patch for vessels which utilizes standard, readily available equipment and which thereby provides increased protection for the environment and substantial reductions in the cost of transporting fuel and liquid chemicals. A further advantage of the invention lies in the fact that by using simple construction with conventional equipment, no special training is needed for the users of the device, so that it may be quickly utilized in the event of an accident. Further, because it requires only known and available equipment, it does not provide a safety hazard to the users.

Although the present invention has been described in terms of preferred embodiments thereof, and although the best mode now contemplated for the invention has been set forth, it should be understood that the disclosed apparatus is exemplary of the inventive concept and that the invention is limited only by the following claims.

What is claimed is:

1. An inflatable, fluid filled patch for covering damaged areas of a vessel hull to prevent leakage of fluid material from the hull, comprising:

an inflatable bladder;

a peripheral frame;

mesh means secured to said frame and covering said bladder for securing the bladder to a hull;

securing cable means for positioning said bladder on the hull;

bracket means having a plurality of legs secured at one end to said peripheral frame and extending thereabove and converging at the other end to a common apex; and tensioning cable means for applying pressure to the apex of said bracket means and thence to said peripheral frame to seal the edges of said bladder against the hull.

2. The patch of claim 1, wherein said bladder includes a layer of foam material located to be pressed against the surface of a hull to permit said patch to conform to irregularities in the hull surface.

3. The patch of claim 1, wherein said mesh consists of interwoven wire strands forming a plurality of loops at the peripheral edge of the mesh.

4. The patch of claim 3, wherein said peripheral frame comprises side and edge frame members interconnected to form a rectangle, said frame members passing through said peripheral loops to secure the mesh to said peripheral frame.

5. The patch of claim 4, wherein said bracket means comprises at least four legs each secured at said one end to a corresponding corner of said rectangular peripheral frame, whereby pressure exerted at said apex by said tensioning cable means is distributed over said peripheral frame.

6. The patch of claim 5, wherein at least one of said bracket means legs is extendable.

7. The patch of claim 4, wherein said periperal frame members are deformable to permit said patch to be shaped to conform to the shape of a hull.

8. The patch of claim 7, further including drive means secured between said apex and at least one of said frame members, said drive means being actuable to deform said frame member to conform its shape to that of the hull.

9. The patch of claim 7, wherein said bracket means comprises at least four legs, each said leg being secured at said one end to a corresponding corner of said rectangular peripheral frame, and further including at least one intermediate leg connected between said apex and one of said peripheral frame members.

10. The patch of claim 9, wherein said intermediate leg includes drive means for extending and retracting said leg, whereby the peripheral frame member to which it is attached may be deformed to press said patch against a hull.

11. The patch of claim 1, further including means for said bladder to block the damaged area of a vessel.

12. The patch of claim 6, wherein said bladder is at least partially filled with water to reduce the buoyancy thereof.

* * * * *